US008098869B2

(12) United States Patent
Okazaki et al.

(10) Patent No.: US 8,098,869 B2
(45) Date of Patent: Jan. 17, 2012

(54) LOUDSPEAKER DAMPER, MANUFACTURING METHOD THEREOF, AND LOUDSPEAKER AND ELECTRONIC DEVICE USING THE SAME

(75) Inventors: Masatoshi Okazaki, Hyodo (JP); Kazuyoshi Mimura, Mie (JP); Shinya Mizone, Mie (JP); Masahide Sumiyama, Mie (JP)

(73) Assignee: Panasonic Corporation, Osaka (JP)

( * ) Notice: Subject to any disclaimer, the term of this patent is extended or adjusted under 35 U.S.C. 154(b) by 1210 days.

(21) Appl. No.: 11/813,681

(22) PCT Filed: Jan. 23, 2006

(86) PCT No.: PCT/JP2006/300936

§ 371 (c)(1),
(2), (4) Date: Jul. 11, 2007

(87) PCT Pub. No.: WO2006/078008

PCT Pub. Date: Jul. 27, 2006

(65) Prior Publication Data

US 2009/0010471 A1 Jan. 8, 2009

(30) Foreign Application Priority Data

Jan. 24, 2005 (JP) ..... 2005-015084

(51) Int. Cl.
*H04R 1/20* (2006.01)

(52) U.S. Cl. ..... 381/354

(58) Field of Classification Search ..... 381/354, 381/150, 337

See application file for complete search history.

(56) References Cited

U.S. PATENT DOCUMENTS

| | | | | |
|---|---|---|---|---|
| 5,945,643 | A | 8/1999 | Casser | |
| 7,678,218 | B2 * | 3/2010 | Suzuki et al. | 156/196 |
| 7,835,538 | B2 * | 11/2010 | Inoue et al. | 381/423 |
| 7,849,958 | B2 * | 12/2010 | Sato et al. | 181/167 |
| 2006/0249327 | A1 * | 11/2006 | Sato et al. | 181/167 |
| 2007/0164477 | A1 * | 7/2007 | Suzuki et al. | 264/299 |

FOREIGN PATENT DOCUMENTS

| | | |
|---|---|---|
| CN | 1404340 A | 3/2003 |
| EP | 0729289 | 8/1996 |
| JP | 50-117411 | 9/1975 |
| JP | 53-24826 | 3/1978 |
| JP | 57-087698 | 6/1982 |
| JP | 64-043000 | 2/1989 |

(Continued)

OTHER PUBLICATIONS

Chinese Office Action dated Jan. 26, 2011.

(Continued)

*Primary Examiner* — Jeffrey Donels
(74) *Attorney, Agent, or Firm* — Pearne & Gordon LLP

(57) ABSTRACT

A loudspeaker damper, a manufacturing method thereof, and a loudspeaker, electronic equipment and device using the loudspeaker damper. The damper has flexibility. Therefore, even if a large input is applied and the damper oscillates with a large amplitude, a resin layer provided on the surface of the damper base material is not cracked due to partial interface peeling. Thus, the damper follows such a large amplitude and realizes high input-resistance. This loudspeaker damper material is obtained by impregnating a material with thermo-setting resin including 2 to 20 wt % of flexibility imparting agent and heat-curing thereof.

18 Claims, 7 Drawing Sheets

FOREIGN PATENT DOCUMENTS

| | | |
|---|---|---|
| JP | 05-168093 | 7/1993 |
| JP | 08-340596 | 12/1996 |
| JP | 2000-080179 | 3/2000 |
| JP | 2000-159835 | 6/2000 |
| JP | 2003-078993 | 3/2003 |
| JP | 2003-078993 A | 3/2003 |
| JP | 2000-196533 | 7/2004 |
| JP | 2004-196533 | 7/2004 |

OTHER PUBLICATIONS

European Search Report Dated Apr. 15, 2008.

* cited by examiner

LOUDSPEAKER DAMPER, MANUFACTURING METHOD THEREOF, AND LOUDSPEAKER AND ELECTRONIC DEVICE USING THE SAME

THIS APPLICATION IS A U.S. NATIONAL PHASE APPLICATION OF PCT INTERNATIONAL APPLICATION PCT/JP2006/300936.

TECHNICAL FIELD

The present invention relates to a loudspeaker damper used in various acoustic equipment, a manufacturing method thereof, and a loudspeaker, electronic equipment and a device using the loudspeaker damper.

BACKGROUND ART

FIG. 5 is a sectional view showing a configuration of a loudspeaker; and FIGS. 6A and 6B are a plan view and a sectional view showing a configuration of a damper used in the loudspeaker. With reference to FIGS. 5, 6A and 6B, this loudspeaker is described.

Magnetic circuit 4 including annular magnetic gap 4*a* is configured by bottom plate 1 having a convex-shaped cross section, ring magnet 2 provided on bottom plate 1, and ring upper plate 3 provided on magnet 2. Such a configuration is referred to as an outer magnet type.

Frame 5 is coupled to upper plate 3. The outer peripheral portion of diaphragm 6 is coupled to frame 5. Voice coil 7 is movably disposed in magnetic gap 4*a*. As shown in FIG. 5, bobbin 7*a* on which a coil of voice coil 7 is wound extends to the side of diaphragm 6 and coupled to the inner peripheral portion of diaphragm 6. The inner peripheral portion of damper 8 is coupled to bobbin 7*a* and the outer peripheral portion of damper 8 is coupled to frame 5. On the central part of the upper surface of diaphragm 6, dust cap 9 for preventing entering of dust is provided.

Furthermore, damper 8 is configured in a concentric circular corrugation form spreading on a surface in order to elastically support voice coil 7 via diaphragm 6 and bobbin 7*a*. Damper 8 is required to have basic performances of being excellent in retaining stability of voice coil 7 and allowing amplitude motion faithfully responding to stress generated in voice coil 7.

Damper 8 is manufactured by a manufacturing process shown in FIG. 7. That is to say, a damper base material is introduced, then impregnated with resin in step 701, and dried in step 702. This resin-impregnated damper base material is hot-pressed by using a die so as to form a corrugation shape in step 703. Thereafter, in a trimming process in step 704, an inner diameter and an outer diameter are punched out by using a die.

The present inventors have proposed, in Japanese Patent Unexamined Publication No. H8-340596, a loudspeaker damper a) being less deteriorated in the basic performance; b) being excellent in water resistance, humidity resistance and heat resistance; c) being excellent in shape-keeping property and less deteriorated in a loudspeaker property after long time of use; and d) in manufacturing process, providing a manufacturing method in which impregnation and molding steps are safe without adversely affecting the working environment and harmful gas is not generated.

The loudspeaker damper proposed in Japanese Patent Unexamined Publication No. H8-340596 includes a cloth composed of fully aromatic polyamide yarns, as a matrix component. The fully aromatic polyamide yarn is a mixed yarn mixed with thermoplastic aromatic polyester fibers having a thermal fusion temperature that is lower than a thermal decomposition temperature by 100° C. or more. In the mixed yarn, fully aromatic polyamide fibers are fixed to each other by fusion of the thermoplastic aromatic polyester fibers. Furthermore, in the mixed yarn, fibers constituting the yarn and fiber surfaces are fixed to each other by a vehicle containing polyester resin. In the cloth, the mixed yarns are fixed to each other at their intersection points by fusion of thermoplastic aromatic polyester fibers and with a vehicle containing polyester resin.

However, recently, in accordance with the digitization of equipment, a loudspeaker used in such equipment is required to have an enlarged dynamic range, that is, high output. However, in the loudspeaker damper shown in Japanese Patent Unexamined Publication No. H8-340596, too much load is applied, so that minimum resonance frequency ($F_0$) of the loudspeaker may be considerably lowered and gap failure may occur because a vibration system of the loudspeaker cannot be sufficiently supported. The present inventors ascertained that such problems are caused by deterioration of the shape-keeping property due to overload to a damper itself during operation of a loudspeaker and that this phenomenon is caused by the reduction in binding strength between a damper base material and resin impregnated into the damper material.

In order to solve such problems, the present inventors have proposed in Japanese Patent Application 2004-196533 that a step of subjecting a base material to surface reforming treatment (corona discharge treatment) before a step of impregnating a base material with resin. The proposition in Japanese Patent Application 2004-196533 makes it possible to improve the wettability of a base material and to improve the conformability between the base material and impregnated resin. Thus, the base material can be impregnated with resin sufficiently, and the binding strength between the base material and the resin can be reinforced.

However, there has been a problem that even a loudspeaker damper described in Japanese Patent Unexamined Publication No. H8-340596 in which the performance is improved by using a thermoplastic aromatic polyester fiber or a loudspeaker damper described in Japanese Patent Application 2004-196533 in which the binding strength between a base material and resin is reinforced by subjecting the base material to corona discharge treatment cannot sufficiently respond to further high output.

That is to say, when a large input is applied to a loudspeaker and a voice coil and a diaphragm oscillate, a damper prevents the oscillation and a resin layer provided on the surface of the damper base material is cracked due to partial interface peeling. Thus, the property is deteriorated.

DISCLOSURE OF THE INVENTION

The present invention has been made in view of the above-described conventional problems. A loudspeaker damper of the present invention includes a material and thermosetting resin including 2 to 20 wt % of flexibility imparting agent, in which the material is impregnated with the thermosetting resin.

REFERENCE MARKS IN THE DRAWINGS

Figure 1:
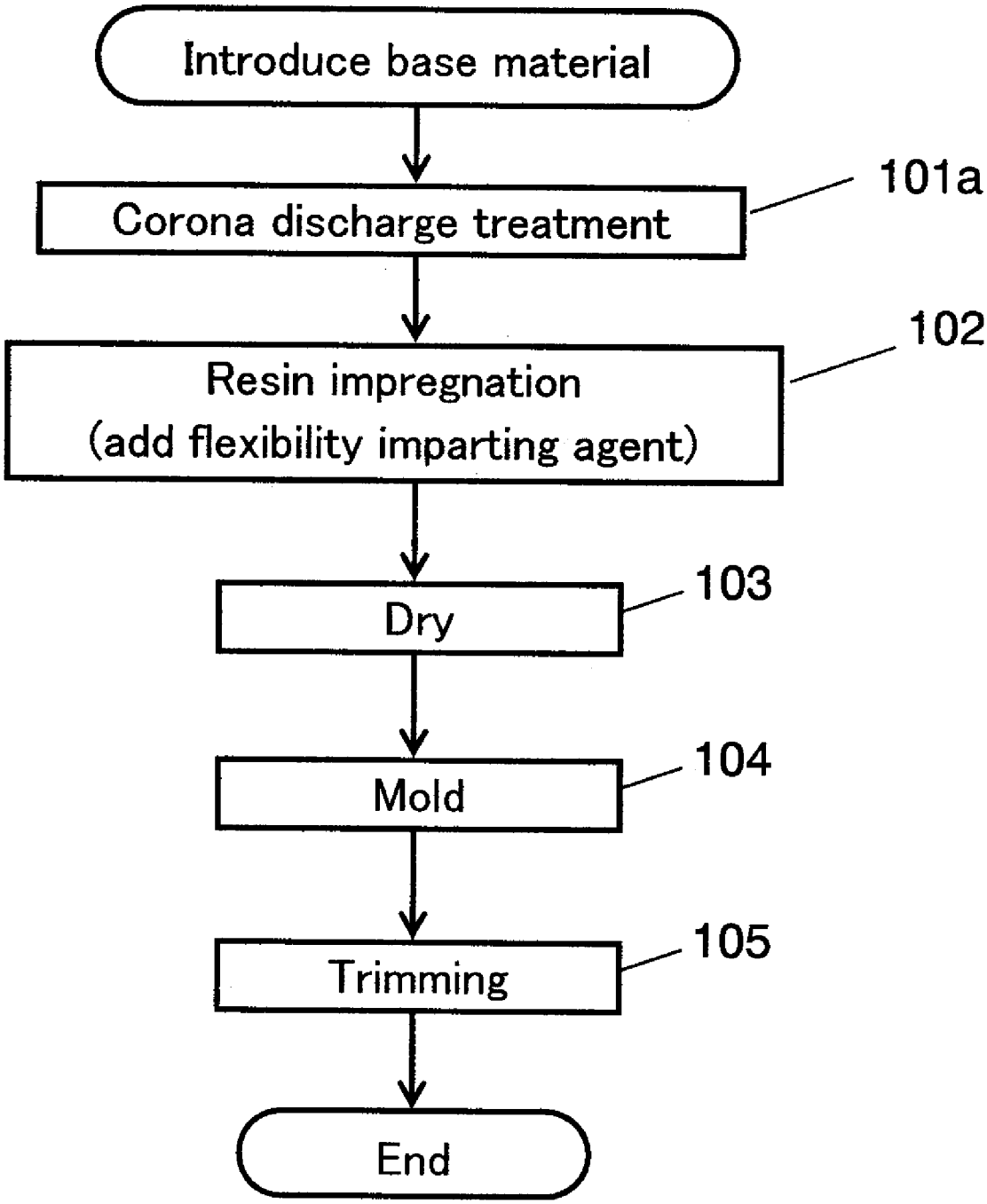
FIG. 1 is a manufacturing process chart showing a manufacturing method of a loudspeaker damper in accordance with one embodiment of the present invention.

1 bottom plate
2 magnet
3 upper plate
4 magnetic circuit
4*a* magnetic gap
5 frame
6 diaphragm
7 voice coil
7*a* bobbin
8 damper
9 dust cap
40 loudspeaker
41 enclosure
42 amplifier
43 player
44 minicomponent system
50 automobile

DETAILED DESCRIPTION OF THE PREFERRED EMBODIMENTS

First Exemplary Embodiment

Figure 5:
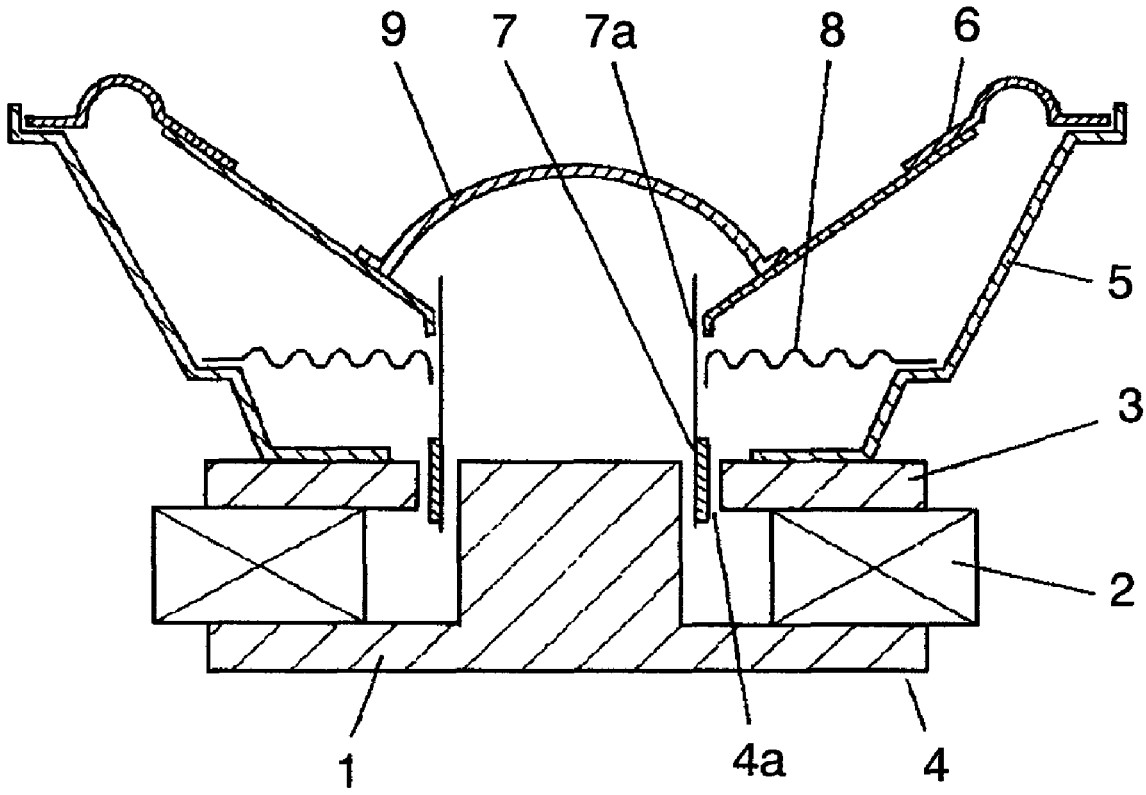
FIG. 5 is a sectional view showing a configuration of a loudspeaker.
Figure 6A:
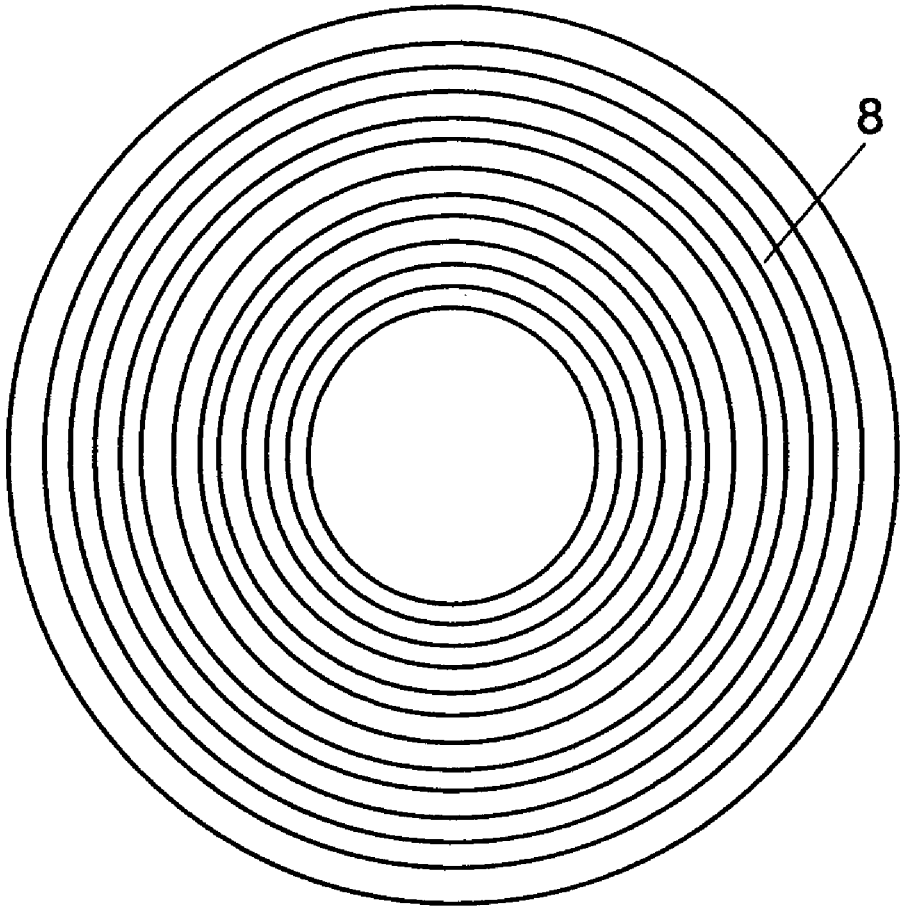
FIG. 6A is a plan view showing a configuration of a damper used in the loudspeaker.
Figure 6B:
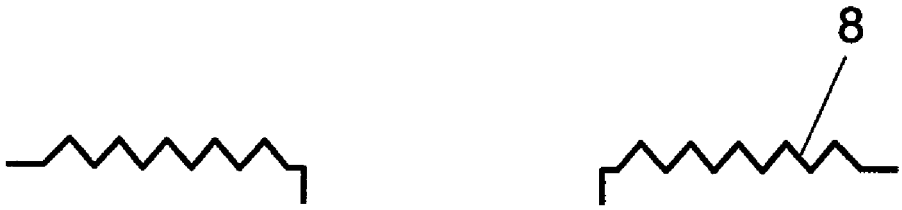
FIG. 6B is a sectional view showing a configuration of a damper used in the loudspeaker.
Figure 7:
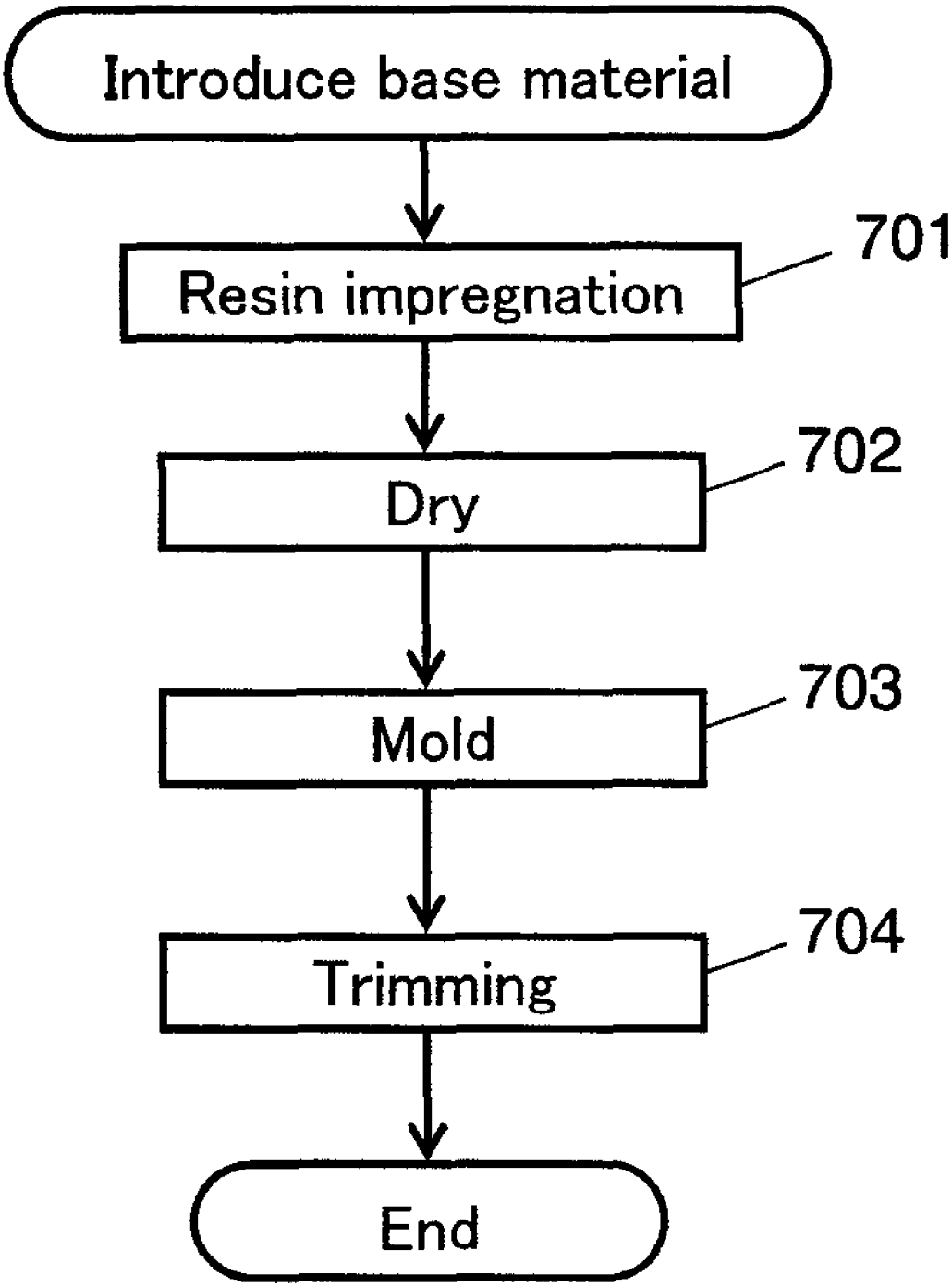
FIG. 7 is a manufacturing process chart showing a manufacturing method of a conventional loudspeaker damper.

Hereinafter, a first exemplary embodiment of the present invention is described. Since a configuration of a loudspeaker using a loudspeaker damper is the same as that described with reference to FIGS. 5, 6A and 6B, the description thereof is omitted herein.

The loudspeaker damper of the first exemplary embodiment is obtained by impregnating a material such as fabric, heat-resistant nylon and polyester with thermosetting resin such as phenolic resin and melamine resin, followed by heat curing the resin impregnated material. The above-mentioned thermosetting resin such as phenolic resin and melamine resin includes 2 to 20% of flexibility imparting agent.

An example of the flexibility imparting agent used in the present invention includes the following well-known flexibility imparting agents:

(a) isocyanates;

(b) glycidylethers;

(c) natural vegetable oils such as linseed oil, castor oil, tung oil, oiticica oil, and dehydrated castor oil;

(d) addition reaction products between natural vegetable oils and phenols;

denatured vegetable oils such as (e) epoxidated linseed oil, and (f) epoxidated castor oil;

(g) addition reaction products between denatured vegetable oils and phenols; and (h) terminal-modified polyethylene glycol.

Among them, liquid rubber is preferable from the viewpoint of compatibility with respect to phenolic resin. In particular, liquid acrylonitrile-butadiene rubber (NBR) is most preferable because it is effective in modifying phenolic resin.

Furthermore, it is preferable that the addition amount of the flexibility imparting agent is in the range from 2 to 20 wt % with respect to the amount of thermosetting resin itself, such as phenolic resin and melamine resin. The amount of less than 2 wt % is not preferable because the effect cannot be sufficiently exhibited. Meanwhile, the amount of more than 20 wt % is not preferable because the rigidity of thermosetting resin is lost. The most effective and preferable range is in the range from 5 to 10 wt %.

From the viewpoint mentioned above, as the most preferable example, NBR emulsion is selected as a flexibility imparting agent. As this NBR emulsion, Nipol (registered trademark) SX1503 is used. The glass-transition temperature of NBR is −20° C.

As a specific Example 1, a damper is produced as follows. Firstly, a material of polyester is used as a damper base material. The material is impregnated with phenolic resin to which the above-mentioned flexibility imparting agent has been added in the amount of 10 wt % in a solid content basis. Then, the resin-impregnated material is heat-cured. The change rate of flexibility after the application of flexure is repeated 1000 times with an amplitude of 5 mm at room temperature is defined as durability of the produced damper. This change rate of flexibility is shown in Table 1 together with the change rate of a conventional product as a comparative example.

TABLE 1

| | Change rate of flexibility (%) |
|---|---|
| Conventional example | 20 |
| Example 1 | 15 |
| Example 2 | 12 |
| Second exemplary embodiment | 7 |

As is apparent from Table 1, a damper in accordance with this exemplary embodiment has flexibility by the configuration in which a flexibility imparting agent is added to a thermosetting resin layer formed on the surface of the damper base material. Therefore, even if the damper oscillates with a large amplitude, it is possible to prevent a resin layer provided on the surface of the damper base material from being cracked due to partial interface peeling. Thus, the damper can follow a large amplitude sufficiently.

As Example 2, 0.001 mol/100 g of hydroxyl group is added to the flexibility imparting agent used in Example 1 and this flexibility imparting agent is added to phenolic resin. The phenolic resin is impregnated into a base material, and this resin-impregnated base material is used so as to produce a damper. The measurement result of the change rate of flexibility of the thus produced damper is also shown in Table 1.

As is apparent from Table 1, when a hydrophilic group is added to the flexibility imparting agent, the compatibility with respect to phenolic resin is improved and the flexibility imparting agent is finely dispersed in the phenolic resin without being condensed. Thus, sufficient flexibility imparting effect can be exhibited.

Second Exemplary Embodiment

Hereinafter, a second exemplary embodiment is described.

In this exemplary embodiment, in the manufacturing process of a damper produced in the first exemplary embodiment, before the step of impregnating a damper base material with phenolic resin including 10 wt % of flexibility imparting agent, a material is subjected to corona discharge treatment. The other configuration and manufacturing method are the same as those in the first exemplary embodiment. Therefore, the detailed description of the same portions are omitted and only different portions are described with reference the drawings as follows.

FIG. 1 is a manufacturing process chart showing a manufacturing method of a loudspeaker damper in accordance with this exemplary embodiment. As shown in FIG. 1, after a base material is introduced, in step 101*a*, the introduced base material is subjected to corona discharge treatment as a surface treatment process. Next, in step 102, resin impregnation process is carried out. In the process, the base materials is impregnated with the thermosetting resin including the flexibility imparting material described in the first exemplary embodiment. Then, in step 103 the material is dried. In step 104, the material is hot-pressed by using a die, so that a corrugation shape is formed. Thereafter, in the trimming process in step 105, an inner diameter and an outer diameter are punched out by using a die.

With this corona discharge treatment in step 101*a*, the wettability of the base material is improved so as to increase the coating property and the conformability between the base material and the impregnated resin is improved. Thus, the binding strength between the base material and the impregnated resin can be enhanced.

Since this surface reforming treatment process by corona discharge treatment can be carried out by irradiating a base material with corona discharge in the atmosphere, a large-scale facility is not needed. Furthermore, even a wide and long base material can be subjected to surface reforming treatment in an online state consecutively and with a simple method. Thus, the treatment can be carried out at a low cost. Furthermore, in the facility of corona discharge, by using a wire electrode as a discharging electrode, discharge energy can be concentrated. Thus, treatment effect can be obtained uniformly even on an irregular surface of a base material such as a woven fabric.

When a chemical fiber material is used for a damper base material, although moisture absorption is smaller as compared with a cotton yarn material, the conformability with respect to resin to be impregnated is often poor. As a chemical fiber material, polyester is widely used as a substitute for a cotton yarn material, and polyester is cheap and highly versatile chemical fiber material next to a cotton yarn material. Even when a chemical fiber material is used, by carrying out the surface reforming treatment, the wettability of a base material is improved, so that the conformability with respect to impregnated resin is improved. Thus, binding strength between the base material and the impregnated resin can be enhanced. The chemical fiber material is not necessarily limited to polyester, and any materials, for example, rayon, aramid, or the like, can be selected in accordance with the required performances. As to texture, many options including woven fabric and knitted fabric are possible.

The measurement result of the change rate of flexibility of the thus produced damper in this exemplary embodiment is also shown in Table 1.

In the manufacturing method of the damper in accordance with this exemplary embodiment, before the step of impregnating the damper base material with phenolic resin including a flexibility imparting agent, the material is subjected to surface reforming treatment by corona discharge treatment. This manufacturing method can improve the wettability of the base material so as to increase the coating property, and improve the conformability between the base material and the impregnated resin. Thus, binding strength between the base material and the impregnated resin can be enhanced. As a result, as shown in Table 1, the change rate of flexibility can be considerably improved.

As the durability of the damper in a loudspeaker using the damper obtained in Example 1, Example 2, and the second exemplary embodiment, the change rate of the minimum resonance frequency ($f_0$) of a loudspeaker using this loudspeaker damper is measured after the loudspeaker is continuously operated for 96 hours in high temperature and high humidity environment. The results are shown in Table 2 together with that of a conventional product.

TABLE 2

| | Loudspeaker $f_0$ change rate (%) |
|---|---|
| Conventional example | 30 |
| Example 1 | 23 |
| Example 2 | 18 |
| Second exemplary embodiment | 13 |

As is apparent from Table 2, the loudspeaker damper in accordance with this exemplary embodiment has flexibility since a resin layer provided on the surface of the damper base material is a material containing a flexibility imparting agent. Therefore, even if a large input is applied to the loudspeaker, so that the damper oscillates with a large amplitude, the loudspeaker damper can follow such a large amplitude. Thus, it is possible to prevent the resin layer provided on the surface of the damper material from being cracked due to partial interface peeling caused by a large amplitude and to realize high input-resistance of a loudspeaker.

In addition, it is possible to prevent inconsistence of the impregnation of resin into a damper base material or occurrence of molding failure caused by moisture absorption during the time between the resin impregnation step and the molding step.

As mentioned above, it is possible to realize a high-performance damper in terms of product quality and reliability, for example, a shape-keeping property, productivity and moldability.

Figure 2:
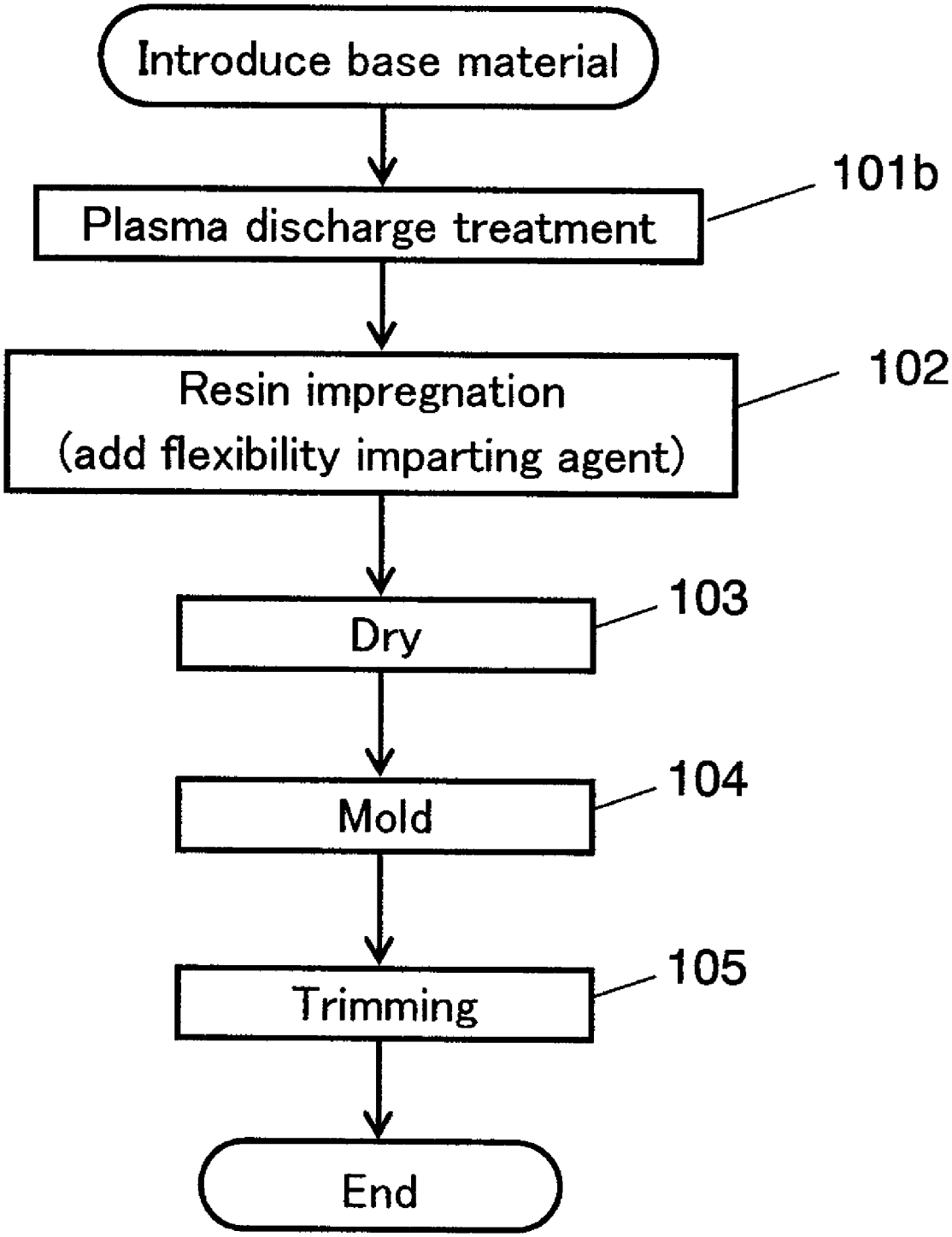
FIG. 2 is a manufacturing process chart showing a manufacturing method of a loudspeaker damper in accordance with one embodiment of the present invention.

Furthermore, this surface reforming treatment process is not necessarily limited to corona discharge treatment (step 101*a*) mentioned above. Alternatively, as shown in FIG. 2, plasma discharge treatment process (step 101*b*) may be employed. In FIG. 2, steps provided with the same reference numerals as those in FIG. 1 show the same treatment mentioned above and the description thereof is omitted.

When this plasma discharge treatment process is employed, similar to the corona discharge treatment process, the wettability of a base material is improved so as to increase the coating property, and the conformability between the base material and the impregnated resin is improved. Thus, binding strength between the base material and the impregnated resin can be enhanced.

Therefore, even if a large input is applied to a loudspeaker, so that a damper oscillates with a large amplitude, the damper can follow such a large amplitude sufficiently. Thus, it is possible to prevent a resin layer provided on the surface of the damper material from being cracked due to partial interface peeling caused by a large amplitude. Thus, high input-resistance of a loudspeaker can be realized.

This can reduce gap failure or reduce deterioration of a damper due to moisture absorption of the damper. Thus, high quality and high reliability can be realized.

Third Exemplary Embodiment

Hereinafter, a third exemplary embodiment is described.

Figure 3:
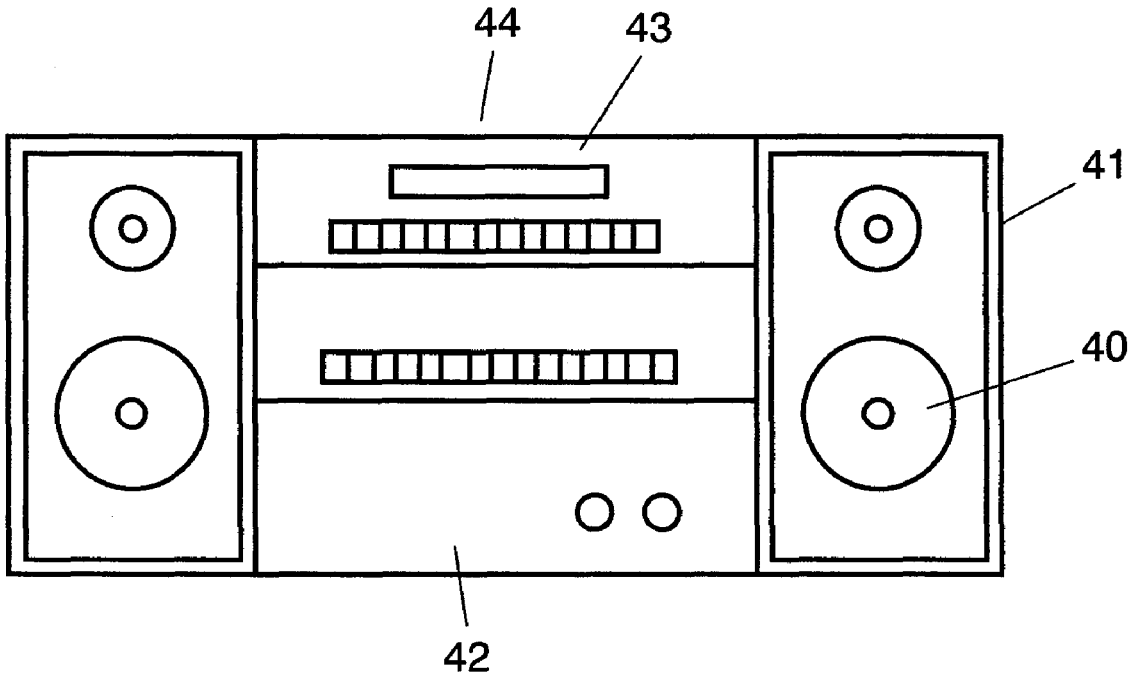
FIG. 3 is an outside view showing electronic equipment in accordance with one embodiment of the present invention.

FIG. 3 is an outside view showing an audio minicomponent system in accordance with one exemplary embodiment of the present invention.

As shown in FIG. 3, a loudspeaker system is configured by incorporating loudspeaker 40 into enclosure 41. Minicomponent system 44 includes amplifier 42 for amplifying electric signals input into this loudspeaker and player 43 for outputting a source input into amplifier 42.

With such a configuration, it is possible to realize high quality and high reliability of electronic equipment having a wide dynamic range and allowing large output according to the digitization of input.

Fourth Exemplary Embodiment

Hereinafter, a fourth exemplary embodiment is described.

Figure 4:
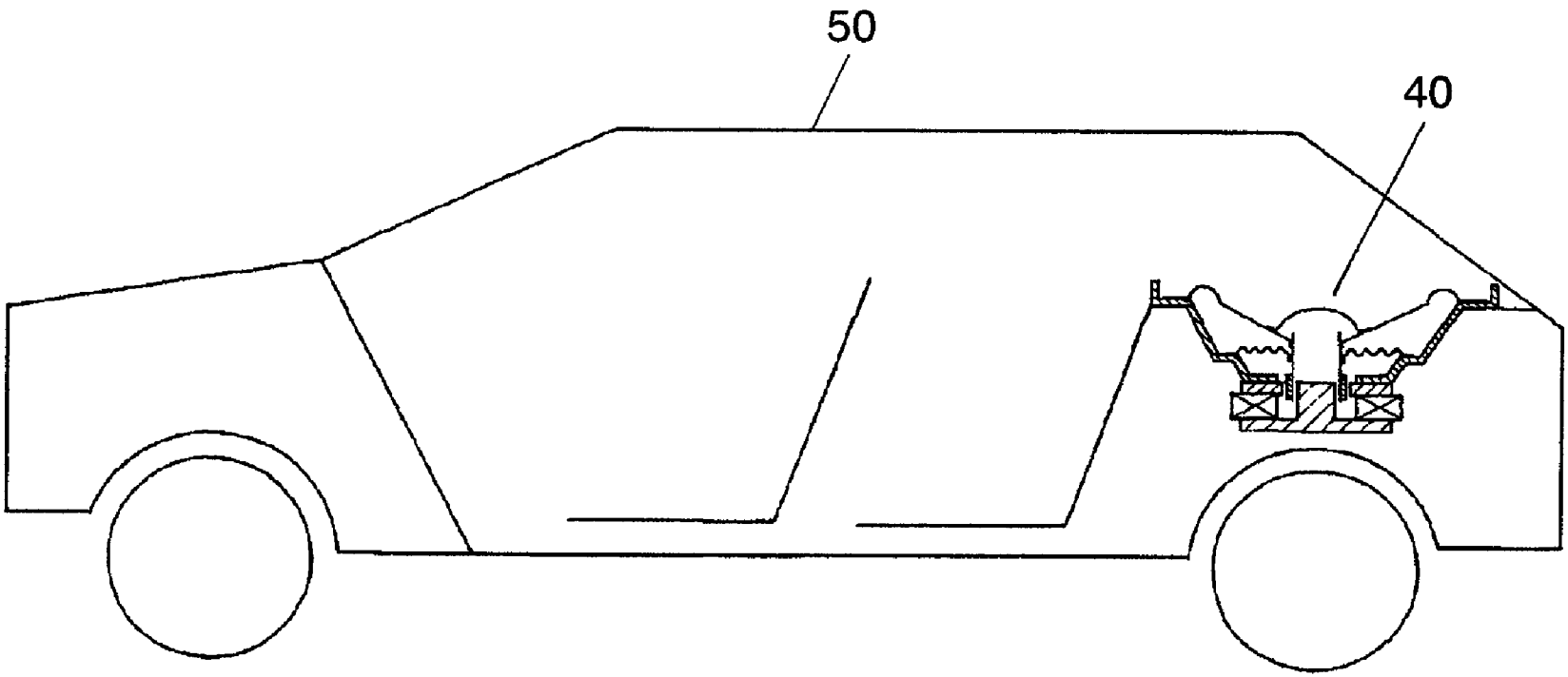
FIG. 4 is a sectional view showing a device in accordance with one embodiment of the present invention.

FIG. 4 is a sectional view showing automobile 50 that is a device having a mobile means in accordance with one exemplary embodiment of the present invention.

As shown in FIG. 4, automobile 50 is configured by incorporating loudspeaker 40 of the present invention into a rear tray.

With such a configuration, it is possible to realize high quality and high reliability of a device in which electronic equipment having a wide dynamic range and allowing large output according to the digitization of input is mounted.

Furthermore, as to performance assurance for a long time of use in an automobile, considerable improvement of the performance can be realized.

INDUSTRIAL APPLICABILITY

In a loudspeaker damper, a manufacturing method thereof and a loudspeaker using the loudspeaker damper in accordance with the present invention, the damper has flexibility because a resin layer provided on the surface of the damper base material contains a flexibility imparting agent. Thus, wide dynamic range and large output can be realized. Therefore, the loudspeaker damper can be widely used for a loudspeaker or electric equipment and device using the loudspeaker.

The invention claimed is:

1. A loudspeaker damper comprising:

a material subjected to a corona discharge treatment to be subjected to a surface reforming process;

a thermosetting resin impregnating the material and heat-cured; and 2 to 20 wt % of acrylonitrile-butadiene rubber (NBR) as a flexibility imparting agent contained in the thermosetting resin.

2. The loudspeaker damper of claim 1, wherein the flexibility imparting agent has a glass transition temperature of 10° C. or less.

3. The loudspeaker damper of claim 1, wherein the flexibility imparting agent includes not less than 0.001 mol/100 g of at least one hydrophilic group selected from a hydroxyl group, a carboxyl group and an amino group.

4. The loudspeaker damper of claim 1, wherein the material is made of any of fabric, aramid and polyester, and the thermosetting resin is phenolic resin or melamine resin.

5. A manufacturing method of the loudspeaker damper of claim 1, the method comprising:

subjecting the material to corona discharge treatment before impregnating the material with the thermosetting resin.

6. The method of claim 5, wherein a wire electrode is used as a discharging electrode in the corona discharge treatment.

7. A loudspeaker comprising:

the loudspeaker damper of claim 1.

8. A loudspeaker comprising:

the loudspeaker damper manufactured by the method of claim 5.

9. The loudspeaker comprising:

the loudspeaker damper manufactured by the method of claim 6.

10. Electronic equipment comprising the loudspeaker of claim 7 and an amplifier of an electric signal to be input into the loudspeaker.

11. Electronic equipment comprising the loudspeaker of claim 8 and an amplifier of an electric signal to be input into the loudspeaker.

12. Electronic equipment comprising the loudspeaker of claim 9 and an amplifier of an electric signal to be input into the loudspeaker.

13. A device comprising the loudspeaker of claim 7 mounted on a mobile means.

14. A device comprising the loudspeaker of claim 8 mounted on a mobile means.

15. A device comprising the loudspeaker of claim 9 mounted on a mobile means.

16. The loudspeaker damper of claim 1, wherein the material is made of woven fabric.

17. The method of claim 5, wherein the material is made of woven fabric.

18. The method of claim 5, wherein said subjecting of the material to corona discharge treatment comprises subjecting of the material to corona discharge treatment in atmosphere.

* * * * *